US010263375B1

(12) United States Patent
Gellert et al.

(10) Patent No.: US 10,263,375 B1
(45) Date of Patent: Apr. 16, 2019

(54) BUSBAR CONNECTOR

(71) Applicant: busSTRUT CORPORATION, Worthington, OH (US)

(72) Inventors: Gregory Gellert, Columbus, OH (US); Denver Clark, Columbus, OH (US); Larry M. Gellert, New Albany, OH (US); Daryl Van Mercetta, Columbus, OH (US)

(73) Assignee: BUSSTRUT CORPORATION, Worthington, OH (US)

( * ) Notice: Subject to any disclaimer, the term of this patent is extended or adjusted under 35 U.S.C. 154(b) by 0 days.

(21) Appl. No.: 16/042,105

(22) Filed: Jul. 23, 2018

(51) Int. Cl.
*H01R 25/00* (2006.01)
*H01R 25/14* (2006.01)

(52) U.S. Cl.
CPC ..... *H01R 25/142* (2013.01); *H01R 25/145* (2013.01)

(58) Field of Classification Search
CPC ..... H01R 25/142; H01R 25/145
USPC ..... 439/110
See application file for complete search history.

(56) References Cited

U.S. PATENT DOCUMENTS 2,261,986 A * 11/1941 Frank ..... H01R 25/14 439/119
3,909,502 A * 9/1975 Lacan ..... H02G 3/0493 174/100
4,655,520 A * 4/1987 Cummings ..... F21V 21/002 439/111
5,152,698 A * 10/1992 Juhlin ..... A47B 21/06 174/482
5,934,818 A * 8/1999 Schmitt ..... H01R 4/4872 403/396
6,019,446 A * 2/2000 Laboch ..... H02B 1/01 211/26
6,296,498 B1 * 10/2001 Ross ..... H01R 25/145 439/115
6,428,127 B1 * 8/2002 Rasmussen ..... A47B 47/0008 312/265.4
6,517,363 B2 * 2/2003 Ross ..... H01R 25/14 439/115
7,049,514 B2 * 5/2006 Brandt ..... H02B 11/12 174/50

(Continued)

OTHER PUBLICATIONS

BusSTRUT Specification Sheet, Jumpers.

*Primary Examiner* — Abdullah A Riyami
*Assistant Examiner* — Vladimir Imas
(74) *Attorney, Agent, or Firm* — Benesch, Friedlander, Coplan & Aronoff LLP

(57) ABSTRACT

An apparatus includes first and second struts, each of which defines a channel and has an open side. The struts together define a juncture at which one of the struts crosses the other. First and second electrical contacts engage busbars in the channels. Wires interconnect the first electrical contacts with the second electrical contacts. A housing contains the wires. The housing has a first elongated portion reaching along the open side of the first strut in a direction from the first electrical contacts toward the juncture, a second elongated portion reaching along the open side of the second strut in a direction from the juncture toward the second electrical contacts, and a corner at which the first and second elongated portions meet in vertical alignment with the juncture.

21 Claims, 8 Drawing Sheets

(56) References Cited

U.S. PATENT DOCUMENTS

| | | | | |
|---|---|---|---|---|
| 7,256,346 | B2 * | 8/2007 | Walter | A47B 96/14<br>174/481 |
| 7,258,555 | B2 * | 8/2007 | Tiesler | B60R 16/03<br>439/110 |
| 7,405,357 | B2 * | 7/2008 | Laurosch | A47B 21/06<br>174/100 |
| 7,635,020 | B2 * | 12/2009 | Hartel | H02B 1/565<br>165/157 |
| 8,147,257 | B2 * | 4/2012 | Bury | H02G 5/025<br>439/110 |
| 8,314,336 | B2 * | 11/2012 | Liang | E04B 9/0428<br>174/40 R |
| 9,190,791 | B1 * | 11/2015 | Jaena | H01R 25/162 |
| 9,351,427 | B2 * | 5/2016 | Lewis, II | H05K 5/0004 |
| 9,520,703 | B2 * | 12/2016 | Jaena | H02G 5/08 |
| 9,847,636 | B2 * | 12/2017 | Marosi | G02B 6/0083 |
| 9,923,341 | B1 * | 3/2018 | Andersson | H01R 25/142 |
| 10,135,208 | B2 * | 11/2018 | Reed | H01R 25/145 |
| 10,177,549 | B2 * | 1/2019 | Hamilton | H01R 25/142 |
| 10,186,801 | B2 * | 1/2019 | Zantout | H01R 13/6205 |
| 10,186,820 | B1 * | 1/2019 | Gellert | H01R 25/142 |
| 2004/0154233 | A1 * | 8/2004 | Hodges | E04B 2/7425<br>52/36.1 |

* cited by examiner

BUSBAR CONNECTOR

TECHNICAL FIELD

This technology includes devices for interconnecting busbars in busways.

BACKGROUND

Electrical bus systems are often used to provide electric power to fixtures such as, for example, lighting fixtures. An overhead bus system may include an array of electric power distribution tracks suspended from a ceiling. The tracks are referred to as busways. The fixtures are suspended from the busways. Specifically, an individual busway typically includes an elongated strut for routing electrical conductors, known as busbars, through the busway. The strut is configured as a channel with an open bottom along its length. The open bottom of the channel provides access to the busbars. An electrical connecting device, such as a fitting or joiner, may be mounted on the strut to interconnect a fixture with the busbars at a selected location along the length of the strut. Another electrical connecting device may interconnect busways that cross one another in the overhead array.

SUMMARY

An apparatus includes first and second struts. The first strut defines a first channel, and has an open side. First busbars are contained in the first channel. The second strut defines a second channel, and also has an open side. Second busbars are contained in the second channel. The two struts together define a juncture at which the one of the struts crosses directly above or below the other.

First electrical contacts engage the first busbars within the first channel. Second electrical contacts engage the second busbars within the second channel. An array of wires interconnects the first electrical contacts with the second electrical contacts.

In a given example of the apparatus, a wire management device supports the array of wires in a configuration having first and second sections. The first section of the wire array reaches from the first electrical contacts horizontally along the open side of the first strut to the juncture of the struts. The second section of the wire array reaches from the juncture horizontally along the open side of the second strut to the second electrical contacts.

The wire management device in the given example further supports the first electrical contacts at a first fixed distance horizontally from the juncture, and supports the second electrical contacts at a second fixed distance horizontally from the juncture.

The wire management device may include a housing containing the wires. The housing may have a first elongated portion reaching along the open side of the first strut in a direction from the first electrical contacts toward the juncture of the struts, and a second elongated portion reaching along the open side of the second strut in a direction from the juncture toward the second electrical contacts. The housing may further include a corner at which the first and second elongated portions meet in vertical alignment with the juncture.

DETAILED DESCRIPTION

Figure 1:
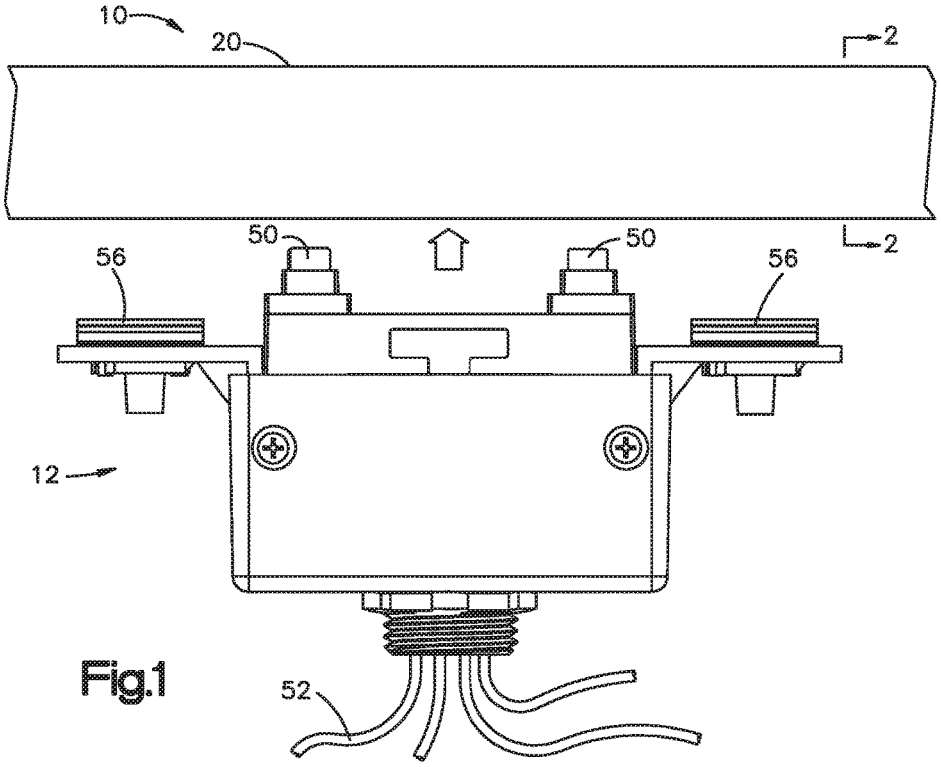
FIG. 1 is a side view of a busway and an electrical fitting for use with the busway.

The apparatus illustrated in the drawings includes parts that are examples of the elements recited in the claims. The illustrated apparatus thus includes examples of how a person of ordinary skill in the art can make and use the claimed invention. These examples are described to meet the enablement and best mode requirements of the patent statute without imposing limitations that are not recited in the claims. One or more elements of one embodiment may be used in combination with, or as a substitute for, one or more elements of another as needed for any particular implementation of the invention.

The apparatus shown in FIG. 1 includes an electrical power distribution track 10 known as a busway. In the side view of FIG. 1, the busway 10 is oriented horizontally in an overhead position that it would take when suspended from a ceiling. Also shown in FIG. 1 is an electrical device 12 for use with the busway 10. The device 12 in this example is a fitting for electrically interconnecting a light fixture or other electrical load device to the busway 10.

Figure 2:
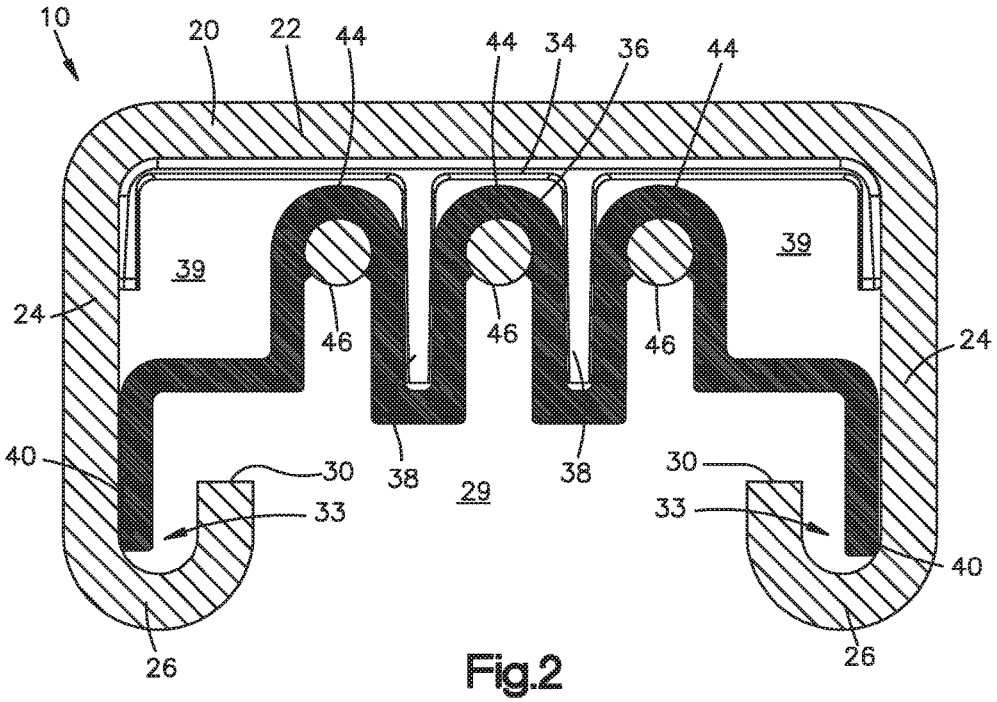
FIG. 2 is a sectional view taken on line 2-2 of FIG. 1.

As shown in the cross-sectional view of FIG. 2, parts of the busway 10 include an elongated strut 20 reaching lengthwise of the busway 10. The strut 20 in the illustrated example has a generally U-shaped cross-section with a top wall 22 and opposite side walls 24. Lower edge portions 26 of the side walls 24 are spaced apart horizontally across the open side of a channel 29 in the strut 20. The lower edge portions 26 are turned inward and upward to provide ledges 30 and grooves 33 reaching alongside the channel 29.

Other parts of the illustrated busway 10 include an isolator 34 and an insulator 36. The isolator 34 and the insulator 36 are both formed of electrically nonconductive material, and are both elongated lengthwise of the strut 20. The isolator 34 includes dividers 38 between compartments 39 at the top of the channel 29. The insulator 36 has side walls 40 received in the grooves 33 in the strut 20, and further has troughs 44 nested within the compartments 39. Each trough 44 contains a respective conductor wire 46 known as a busbar. The busbars 46 are accessible from beneath along the open lengths of the troughs 44.

The fitting 12 is configured for electrically connecting the electrical load device to the busbars 46 at a selected location along the length of the strut 20. Electrical contactors 50 protrude from the top of the fitting 12 for contact with the busbars 46. Wires 52 extend outward from the bottom of the fitting 12 for delivering power from the busbars 46 to the load device.

Figure 3:
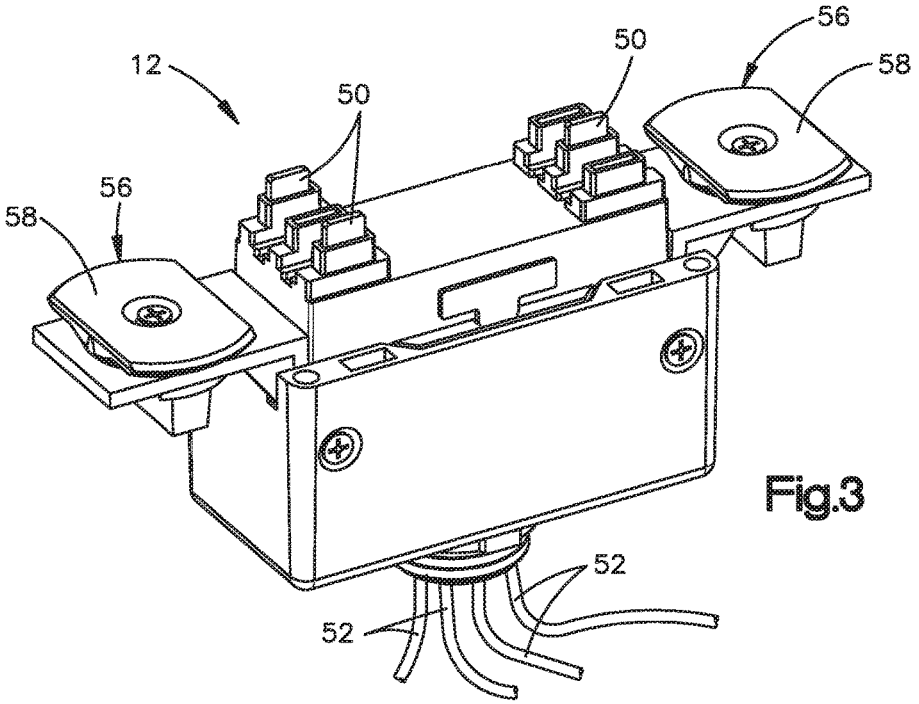
FIG. 3 is a perspective view, taken from above, of the fitting of FIG. 1.

Locking mechanisms 56 are provided for releasably securing the fitting 12 in the channel 29 at the selected location on the strut 20. Each locking mechanism 56 include a cam 58 that is manually rotatable into and out of a position extending laterally outward from both sides of the fitting 12, as shown in FIG. 3. The fitting 12 is first lifted into the channel 29 in the strut 20, with the cams 58 spaced apart along the length of the strut 20. The cams 58 are then rotated to the laterally extending positions. Each cam 58 then reaches across the channel 29, and overlies the adjacent ledges 30 (FIG. 2) at the opposite sides of the channel 29 to support the fitting 12 on the strut 20.

Figure 4:
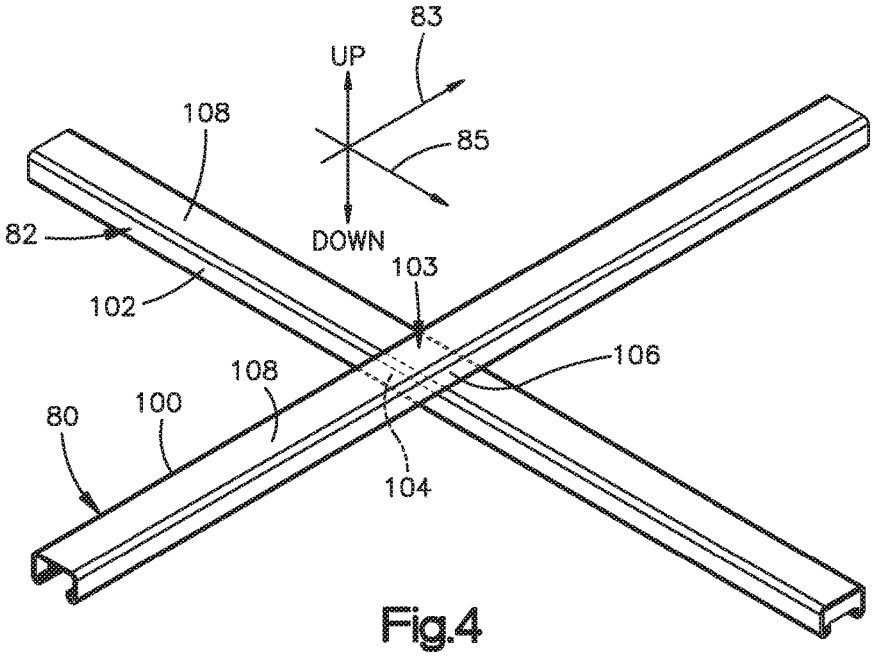
FIG. 4 is a perspective view, taken from above, of a pair of crossed busways in an overhead array.

As shown in FIG. 4, an overhead array of busways may include first and second busways 80 and 82 that cross one another. In this example, the busways 80 and 82 reach lengthwise in respective horizontal directions 83 and 85 that intersect at a right angle, with the second busway 82 reaching across and beneath the first busway 80.

The busways 80 and 82 of FIG. 4 are both configured like the busway 10 described above. The busways 80 and 82 thus include first and second struts 100 and 102 like the strut 20 of FIGS. 1 and 2. In the crossed arrangement of FIG. 4, the two struts 100 and 102 define a juncture 103 at which a portion 104 of the second strut 102 is located directly beneath a portion 106 of the first strut 100.

Figure 5:
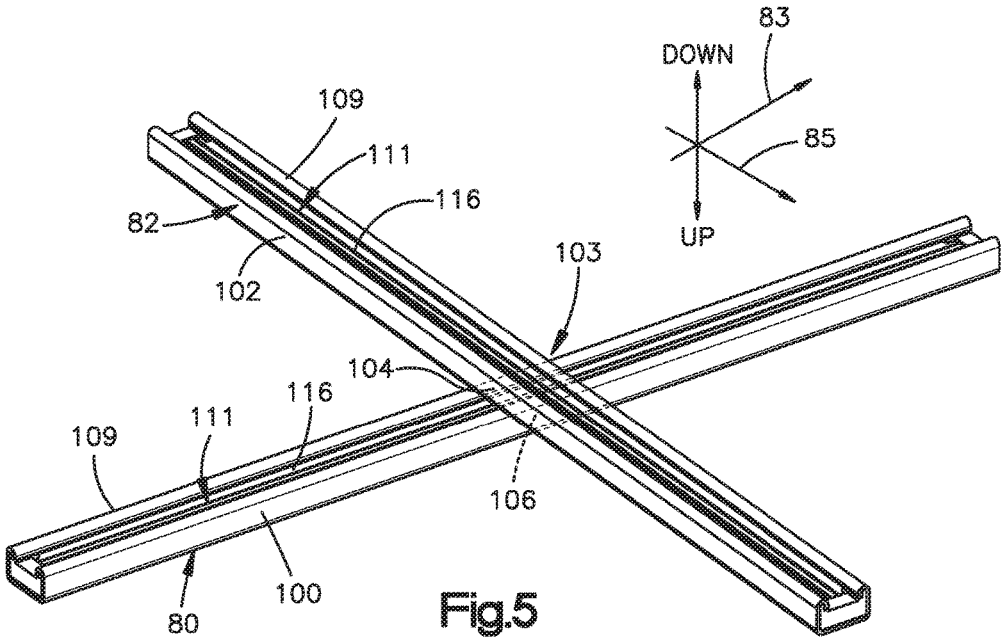
FIG. 5 is a vertically inverted view of the crossed busways of FIG. 4.

Each strut 100 and 102 has a top wall 108 facing upward and, as shown in the vertically inverted view of FIG. 5, defines a channel 109 with an open side 111 facing downward. Busbars 116 are accessible from beneath at the open sides 111 of the channels 109. The fitter 12 can be installed in the open side 111 of either one of the channels 109 at any selected location along the length of the strut 100 or 102.

Figure 6:
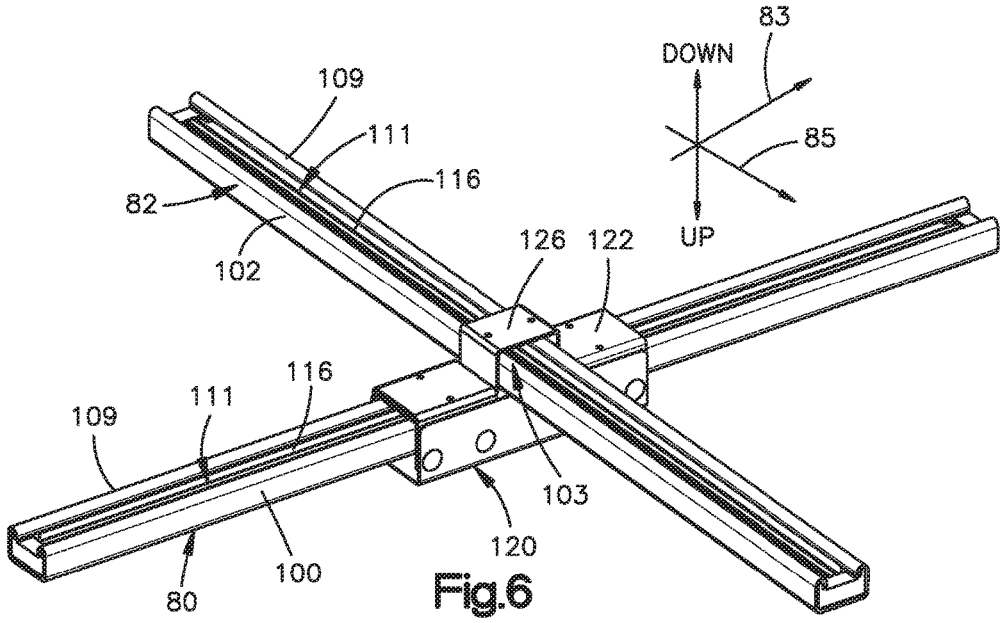
FIG. 6 is a vertically inverted view similar to FIG. 5, showing a clamping device mounted on the crossed busways.

A cross-over clamp 120 may be provided to secure the two struts 100 and 102 directly together. In the example of FIG. 6, the clamp 120 includes a sleeve 122 received lengthwise over the first strut 100. The clamp 120 further includes a strap 126 that reaches from the sleeve 122 in a U-shaped configuration around three sides of the second strut 102.

Figure 7:
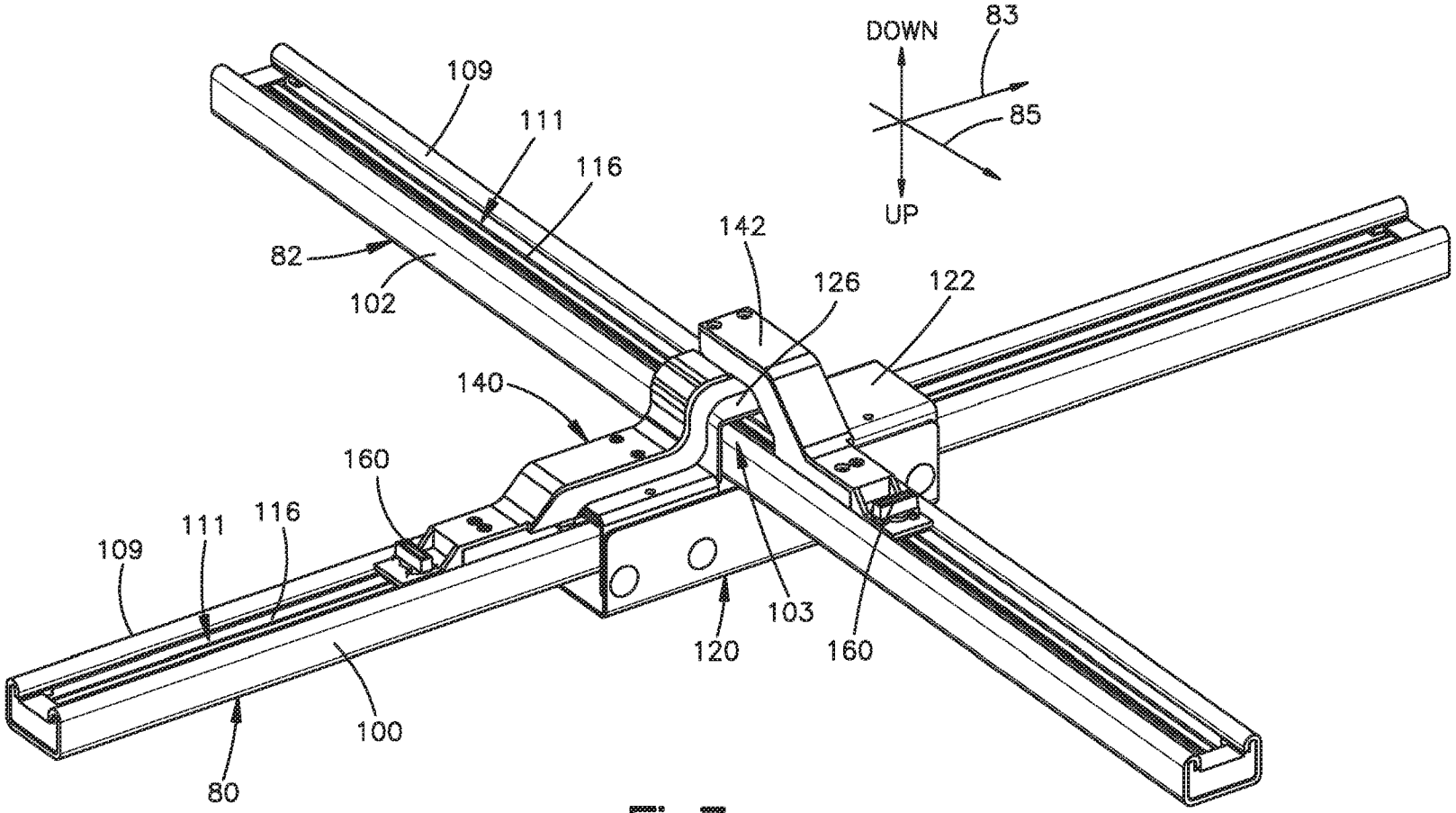
FIG. 7 is a vertically inverted view similar to FIG. 6, showing a busbar interconnection device mounted on the crossed busways.
Figure 8:
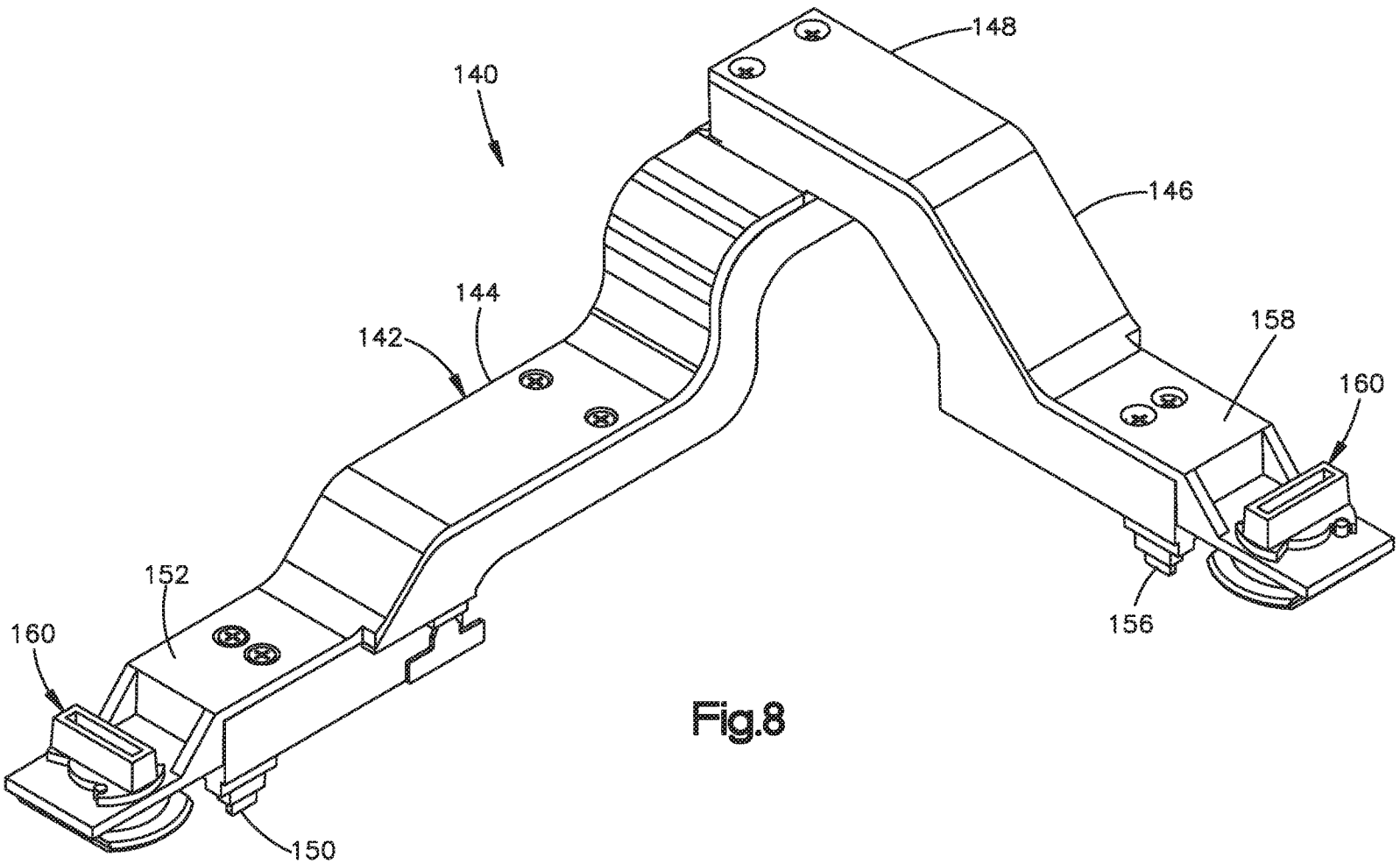
FIG. 8 is an enlarged perspective view of the busbar interconnection device of FIG. 7.

As shown in FIG. 7, a busbar interconnection device 140 is provided to interconnect the busbars 116 in the first strut 100 with the busbars 116 in the second strut 102. The interconnection device 140 in the illustrated example includes a wire management device in the form of a housing 142. As shown in the enlarged view of FIG. 8, the housing 142 has first and second elongated sections 144 and 146. The two elongated housing sections 144 and 146 have linear configurations that intersect at a right angle to form a corner 148 of the housing 142. The first housing section 144 is narrower than the first strut 100. The second housing section 146 is narrower than the second strut 102.

First electrical contacts 150 protrude outward from a free end portion 152 of the first housing section 144. Second electrical contacts 156 similarly protrude outward from a free end portion 158 of the second housing section 146. Wires reach through the housing 142 from the first contacts 150 to the second contacts 156 to electrically interconnect the contacts 150 and 156 within the housing 142. The protruding contacts 150 and 156 are configured and arranged to make contact with the busbars 116 in the struts 100 and 102 in the same manner that the contacts 50 in the fitting 12 of FIGS. 1-3 make contact with the busbars 46 in the strut 20.

Locking mechanisms 160 are provided at the free end portions 152 and 158 of the housing sections 144 and 146. The locking mechanisms 160 are configured in the same manner as the locking mechanisms 56 described above.

In the installed position of FIG. 7, the free end portion 152 of the first housing section 144 is received within the open side 111 of the first strut 100. The electrical contacts 156 at the free end portion 152 engage the busbars 116 in the respective channel 109. The respective locking mechanism 160 secures the first housing section 144 to the first strut 100. The first housing section 144 then reaches lengthwise along the open side 111 of the first strut 100 in the horizontal direction 83 fully from the first electrical contacts 150 to the juncture 103 with the second strut 102.

As further shown in FIG. 7, the free end portion 158 of the second housing section 146 is received in the open side 111 of the second strut 102. The electrical contacts 150 at the free end portion 158 engage the busbars 116 in the respective channel 109, and the locking mechanism 160 secures the second housing section 146 to the second strut 102. The second housing section 146 then reaches lengthwise along the open side 111 of the second strut 102 in the horizontal direction 85 fully from the juncture 103 to the second electrical contacts 156.

Figure 9:
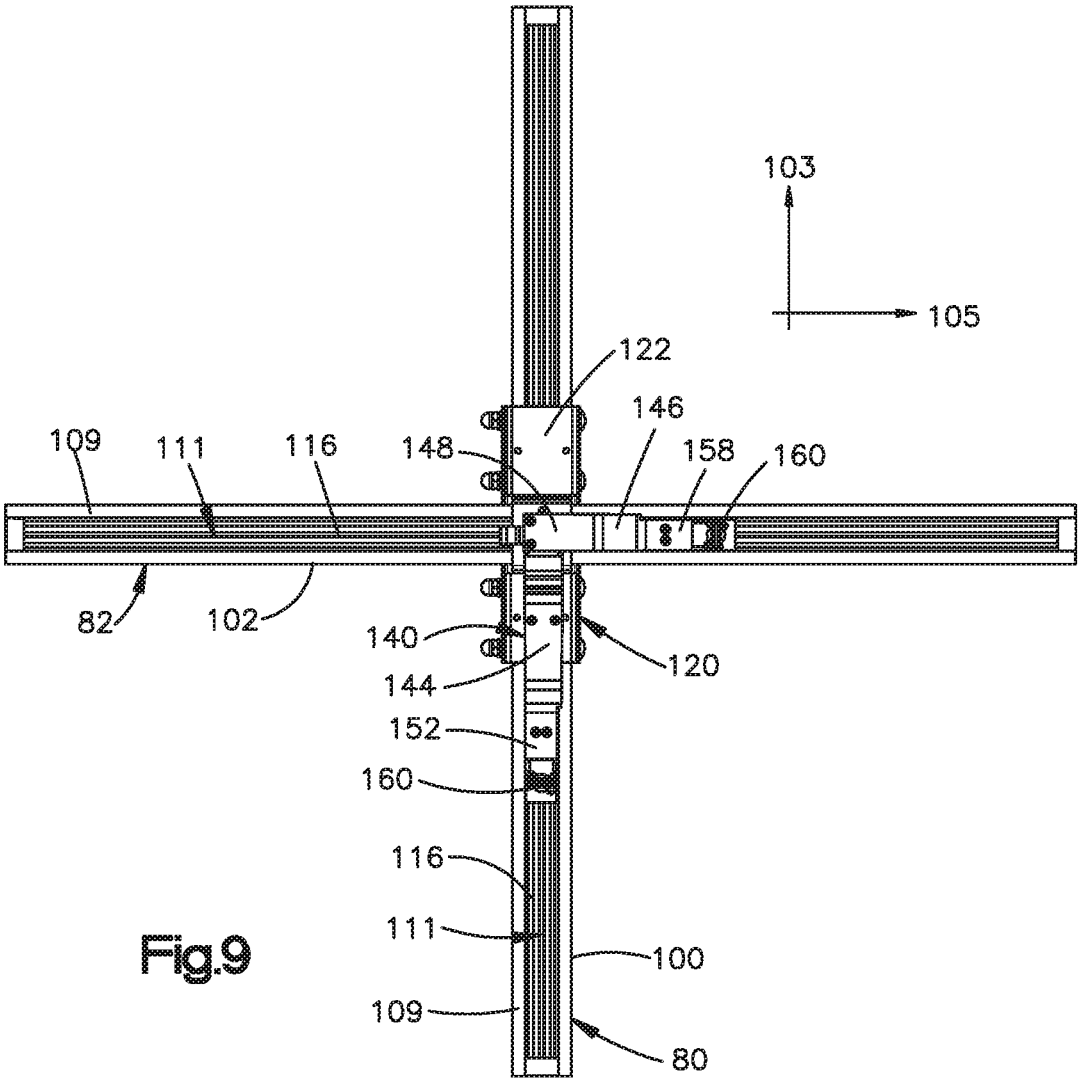
FIG. 9 shows the busbar interconnection device and the crossed busways of FIG. 7 as those parts would be viewed from directly beneath.

Several features of the interconnection device 140 help to minimize the visual prominence of the device 140 when the overhead array of busways is viewed from below at floor level. For example, the corner 148 of the housing 140 is located directly beneath the juncture 103 of the first and second struts 100 and 102. The first housing section 144 reaches vertically downward from the first strut 100 to the corner 148, but does so only along the open side 111 directly beneath the first strut 100. The second housing section 146 reaches vertically upward from the corner 148 to the second strut 102, but does so only along the open side 111 directly beneath the second strut 102. Since the housing sections 144 and 146 are narrower than the struts 100 and 102, they traverse the differing elevations at the juncture 103 without reaching laterally outward from the struts 100 and 102. In this configuration the visual outline of the device 140 appears within the visual outline of the crossed struts 100 and 102 when viewed from below, as shown in FIG. 9. Only the cross-over clamp 120 has parts that project horizontally outward from the visual outline of the crossed struts 100 and 102 in this example of the apparatus.

Additionally, the housing 142 is preferably inflexible such that the sections 144 and 146 of the housing 142 retain the first and second electrical contacts 150 and 156 at fixed distances from the corner 148. Each free end portion 152 and 158 of a housing section 144 and 146 is configured for installation in a channel 109 in only a single orientation in which the respective section 144 or 146 is aligned with the open side 111 of the respective strut 100 or 102. This ensures that the housing sections 144 and 146, which are linear, reach in the respective horizontal directions 83 or 85 fully between the corner 148 and the respective free end portions 152 or 158 as shown in FIG. 9.

Figure 10:
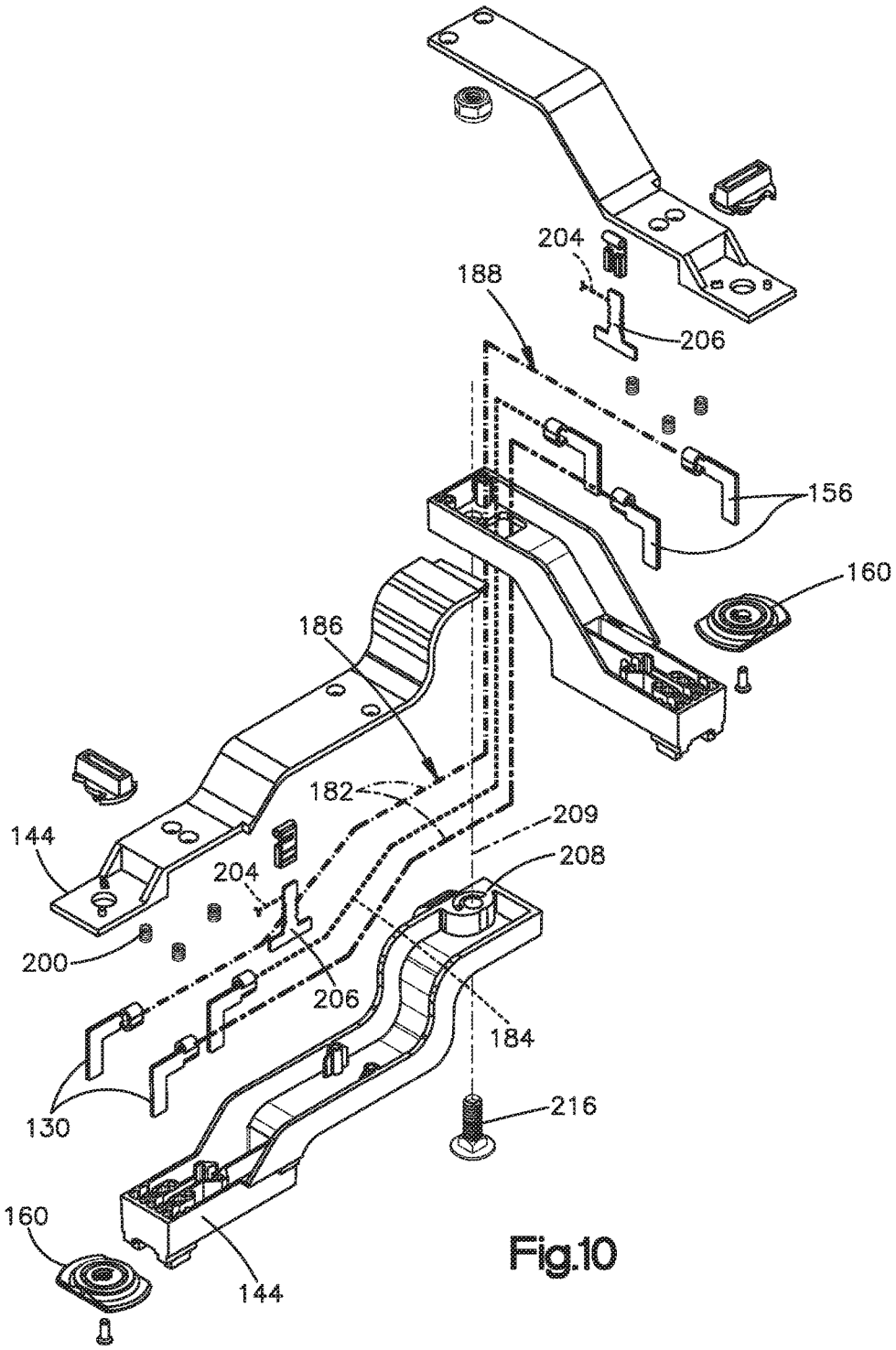
FIG. 10 is an exploded view of the busbar interconnection device of FIG. 7.

Additional parts of the interconnection device 140 are shown in the exploded view of FIG. 10. These include the wires (shown schematically) interconnecting the first and second electrical contacts 150 and 156. The wires are arranged side-by-side in an array including two hot wires 182 and a neutral wire 184. A first section 186 of the wire array reaches through the first housing section 144 from the first electrical contacts 150 to the corner 148 of the housing 142. The first section 186 of the wire array is thus guided lengthwise along open side 111 of the first strut 100 at a location that is outside the channel 109 but within the lateral confines of the housing 142.

A second section 188 of the wire array reaches through the second housing section 146 from the corner 148 to the second electrical contacts 156. Accordingly, the second section 188 of the wire array also is guided lengthwise along open side 111 of the associated strut 102 at a location that is outside the channel 109 but within the lateral confines of the housing 142.

Other parts shown in FIG. 10 include springs 200 for biasing the contacts 150 and 156 outwardly of the housing 142 for effective contact with the busbars 116. The contacts 150 and 156 are preferably crimped directly against uninsulated end portions of the wires 182 and 184. A ground wire 204 interconnects ground contacts 206 that reach outward of the housing sections 144 and 146 for contact directly with the two struts 100 and 102.

Figure 11:
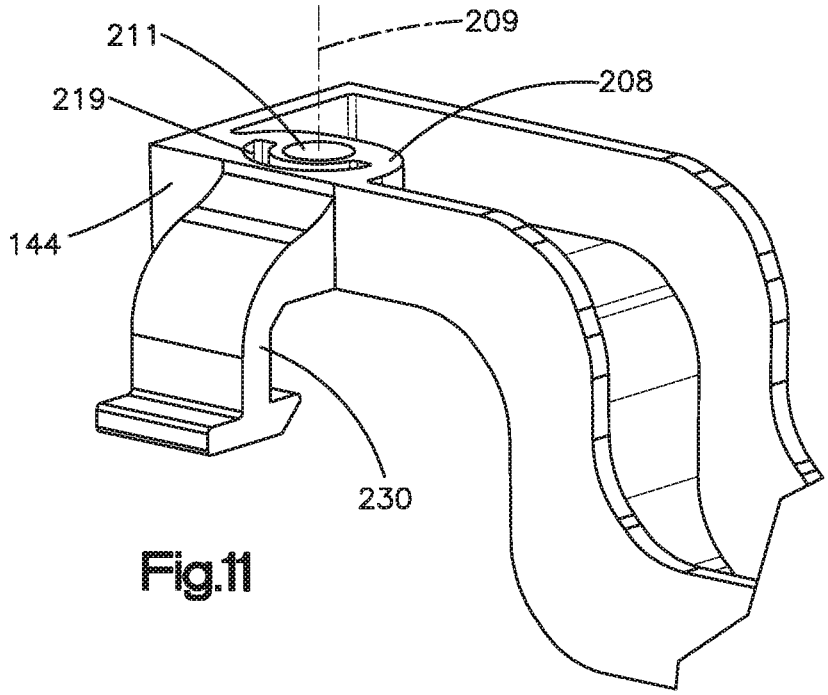
FIG. 11 is an enlarged partial view of a part shown in FIG. 10.
Figure 12:
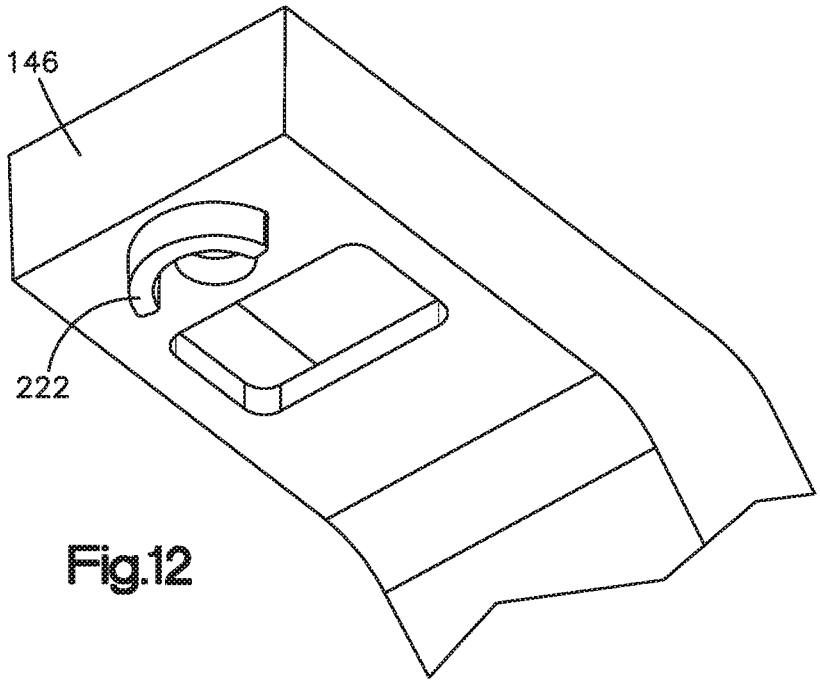
FIG. 12 is an enlarged partial view of another part shown in FIG. 10.

As shown in FIGS. 10 and 11, a hinge 208 is provided at the corner 148 of the housing 142. The hinge 208 enables movement of the two housing sections 144 and 146 relative to one another pivotally about a vertical axis 209. Specifically, the hinge 208 includes a bore 211 that is centered on the axis 209. The bore 211 receives a bolt 216 that interconnects the two housing sections 144 and 146 and serves as a hub at the axis 209. An arcuate groove 219 on the first housing section 144 receives an arcuate key 222 (FIG. 12) on the second housing section 146. The length of the groove 219 provides a limited range through which the key 222 can move within the groove 219 rotationally about the axis 209. The two housing sections 144 and 146 have the same range of movement pivotally relative to one another. In the illustrated embodiment, the range of movement is only great enough to accommodate a misalignment error for which the actual angle between the crossed struts 100 and 102 might deviate from 90 degrees. Accordingly, another embodiment could have a longer groove 219 to provide a greater range of movement for installation of the housing sections 144 and 146 at acute angles on struts that cross at such angles.

Also shown in FIG. 11 is a clip 230 at one side of the first housing section 144. The clip engages the strap 126 at the cross-over clamp 120 to retain the housing 142 securely in the installed position shown in FIG. 7. This restrains the housing 142 from moving vertically away from the struts 100 and 102 under the influence of gravity. The clip 230 also restrains the housing 142 from moving vertically away from the struts 100 and 102 under the forces of the springs 200. Specifically, the springs 200 act between the housing 142 and the electrical contacts 150 and 156 to urge the contacts 150 and 156 vertically upward from the housing 142 into engagement with the busbars 116 in the struts 100 and 102. The clip 230 prevents the spring forces from moving the housing 142 vertically downward from the struts 100 and 102.

This written description sets for the best mode of carrying out the invention, and describes the invention so as to enable a person of ordinary skill in the art to make and use the invention, by presenting examples of the elements recited in the claims. The detailed descriptions of those elements do not impose limitations that are not recited in the claims, either literally or under the doctrine of equivalents.

What is claimed is:

1. An apparatus comprising:

a first strut that defines a first channel and has an open side, with first busbars contained in the first channel;

a second strut that defines a second channel and has an open side, with second busbars contained in the second channel, wherein the first and second struts together define a juncture at which the one of the struts crosses either above or below the other;

first electrical contacts engaging the first busbars within the first channel;

second electrical contacts engaging the second busbars within the second channel;

an array of wires interconnecting the first electrical contacts with the second electrical contacts; and a wire management device supporting the array of wires in a configuration having a first section that reaches from the first electrical contacts horizontally along the open side of the first strut to the juncture, and having a second section that reaches from the juncture horizontally along the open side of the second strut to the second electrical contacts;

wherein the wire management device supports the first electrical contacts at a first fixed distance horizontally from the juncture, and supports the second electrical contacts at a second fixed distance horizontally from the juncture.

2. An apparatus as defined in claim 1, wherein the struts cross at the juncture at a right angle.

3. An apparatus as defined in claim 1, wherein the struts cross at the juncture at an acute angle.

4. An apparatus as defined in claim 1, wherein the wire management device includes a housing having a first elongated portion that contains the first electrical contacts and the first section of the wires, a second elongated portion that contains the second electrical contacts and the second section of the wires, and a corner at which the first and second elongated portions meet.

5. An apparatus as defined in claim 4, wherein the wire management device further includes a hinge interconnecting the first and second elongated portions of the housing for movement pivotally relative to one another.

6. An apparatus as defined in claim 4, wherein the first elongated portion of the housing is narrower than the first strut, and the second elongated portion of the housing is narrower than the second strut.

7. An apparatus as defined in claim 6, wherein the first elongated portion of the housing has a free end received within the open side of the first strut.

8. An apparatus as defined in claim 7, wherein the second elongated portion of the housing has a free end received within the open side of the second strut.

9. An apparatus comprising:

a first strut that defines a first channel and has an open side, with first busbars contained in the first channel;

a second strut that defines a second channel and has an open side, with second busbars contained in the second channel, wherein the first and second struts together define a juncture at which one of the struts crosses either above or below the other;

first electrical contacts engaging the first busbars within the first channel;

second electrical contacts engaging the second busbars within the second channel;

wires interconnecting the first electrical contacts with the second electrical contacts; and a housing containing the wires, the housing having a first elongated portion reaching along the open side of the first strut in a direction from the first electrical contacts toward the juncture, a second elongated portion reaching along the open side of the second strut in a direction from the juncture toward the second electrical contacts, and a corner at which the first and second elongated portions meet in vertical alignment with the juncture.

10. An apparatus as defined in claim 9, further including a hinge interconnecting the first and second elongated portions of the housing for relative movement pivotally about a vertical axis at the corner of the housing.

11. An apparatus as defined in claim 9, wherein the first elongated portion of the housing is narrower than the first strut, and the second elongated portion of the housing is narrower than the second strut.

12. An apparatus as defined in claim 9, wherein the first elongated portion of the housing has a free end received within the open side of the first strut, and the second elongated portion of the housing has a free end received within the open side of the second strut.

13. An apparatus as defined in claim 12, wherein the first electrical contacts project outward from the free end of the first elongated portion of the housing, and the second electrical contacts project outward from the free end of the second elongated portion of the housing.

14. An apparatus as defined in claim 9, wherein both the first and second elongated portions of the housing project vertically and horizontally away from the corner of the housing.

15. An apparatus as defined in claim 9 further comprising a clamp securing the first and second struts together at the juncture, and a clip securing the housing to the clamp at the corner of the housing.

16. An apparatus comprising:

a first strut that defines a first channel and has an open side, with first busbars contained in the first channel;

a second strut that defines a second channel and has an open side, with second busbars contained in the second channel, wherein the first and second struts together define a juncture at which one of the struts crosses either above or below the other;

a housing comprising an inflexible structure having a first linear portion that is narrower than the first strut and reaches along the open side of the first strut in a direction toward the second strut, a second linear portion that is narrower than the second strut and reaches along the open side of the second strut in a direction away from the first strut, and a corner at which the first and second linear portions meet in vertical alignment with the juncture;

first electrical contacts projecting outward from the first linear portion of the housing into contact with the first busbars in the first channel;

second electrical contacts projecting outward from the second linear portion of the housing into contact with the second busbars in the second channel; and wires reaching through the first linear portion of the housing from the first electrical contacts to the corner, and reaching further through the second linear portion of the housing from the corner to the second electrical contacts.

17. An apparatus as defined in claim 16, further including a hinge interconnecting the first and second linear portions of the housing for movement pivotally relative to one another.

18. An apparatus as defined in claim 17 wherein the hinge is located at the corner of the housing.

19. An apparatus as defined in claim 16, wherein the first linear portion of the housing has a free end received within the open side of the first strut, and the second linear portion of the housing has a free end received within the open side of the second strut.

20. An apparatus as defined in claim 19, wherein the first electrical contacts project outward from the free end of the first linear portion of the housing, and the second electrical contacts project outward from the free end of the second linear portion of the housing.

21. An apparatus as defined in claim 16, wherein both the first and second linear portions of the housing project vertically and horizontally away from the corner of the housing.

* * * * *